US011867172B2

(12) United States Patent
Suhara

(10) Patent No.: US 11,867,172 B2
(45) Date of Patent: Jan. 9, 2024

(54) UNIAXIAL ECCENTRIC SCREW PUMP

(71) Applicant: HEISHIN Ltd., Hyogo (JP)

(72) Inventor: Nobuhisa Suhara, Shiga (JP)

(73) Assignee: HEISHIN Ltd., Hyogo (JP)

( * ) Notice: Subject to any disclaimer, the term of this patent is extended or adjusted under 35 U.S.C. 154(b) by 112 days.

(21) Appl. No.: 17/636,398

(22) PCT Filed: Jun. 29, 2020

(86) PCT No.: PCT/JP2020/025447
§ 371 (c)(1),
(2) Date: Feb. 18, 2022

(87) PCT Pub. No.: WO2021/039091
PCT Pub. Date: Mar. 4, 2021

(65) Prior Publication Data

US 2022/0299025 A1 Sep. 22, 2022

(30) Foreign Application Priority Data

Aug. 29, 2019 (JP) ..... 2019-156945
Apr. 1, 2020 (JP) ..... 2020-065595

(51) Int. Cl.
*F04C 15/00* (2006.01)
*F04C 2/107* (2006.01)

(52) U.S. Cl.
CPC ..... *F04C 15/0073* (2013.01); *F04C 2/107* (2013.01); *F04C 2240/10* (2013.01); *F04C 2240/30* (2013.01)

(58) Field of Classification Search
CPC .. F04C 15/0073; F04C 2/107; F04C 2240/10; F04C 2240/30
See application file for complete search history.

(56) References Cited

U.S. PATENT DOCUMENTS 9,109,595 B2 8/2015 Daunheimer
2001/0005486 A1* 6/2001 Wood ..... F03C 2/08 418/152
2011/0305589 A1* 12/2011 Daunheimer ..... F04C 2/1071 418/201.1
2016/0341196 A1* 11/2016 Tanaka ..... F04C 2/1075
2016/0341197 A1* 11/2016 Tanaka ..... F04C 15/0034
2018/0003174 A1* 1/2018 Ba ..... F04C 2/1071
2018/0010603 A1* 1/2018 Voit ..... F01C 21/102
2019/0257308 A1* 8/2019 Overmeier ..... F04C 2/1075

FOREIGN PATENT DOCUMENTS

JP 2018-507347 A 3/2018

OTHER PUBLICATIONS

International Search Report for corresponding Application No. PCT/JP2020/025447, dated Jul. 21, 2020.

* cited by examiner

*Primary Examiner* — Shafiq Mian
(74) *Attorney, Agent, or Firm* — Renner, Otto, Boisselle & Sklar, LLP

(57) ABSTRACT

A uniaxial eccentric screw pump includes: a rotor 1 including a shaft body of a male screw type; a stator 2 having a through hole 2*a* of a female screw type through which the rotor 1 is inserted; a casing 3 connected to one end side of the stator 2; an end stud 4 connected, to the other end side of the stator 2; and a position adjusting member 5 that adjusts a relative position of the stator 2 with respect to the rotor 1 in an axial direction.

15 Claims, 15 Drawing Sheets

UNIAXIAL ECCENTRIC SCREW PUMP

This is a national phase application in the United States of International Patent Application No. PCT/JP2020/025447 with an international filing date of Jun. 29, 2020, which claims priority of Japanese Patent Application No. 2019-156945 filed on Aug. 29, 2019 the contents of which are incorporated herein by reference.

TECHNICAL FIELD

The present invention relates to a uniaxial eccentric screw pump.

BACKGROUND ART

Conventionally, there has been known a uniaxial eccentric screw pump including a rotor formed in a spiral shape and having a conical shape from one end toward the other end, and a stator having a through hole through which the rotor is inserted (see U.S. Pat. No. 9,109,595, for example).

However, in the conventional uniaxial eccentric screw pump, a mechanism for adjusting the relative positional relationship between the stator and the rotor in the axial direction has not been studied sufficiently.

SUMMARY OF THE INVENTION

An aspect of the present invention provides, as means for solving the above problem, a uniaxial eccentric screw pump including: a rotor including a male threaded shaft body; a stator having a female threaded through hole through which the rotor is inserted; a casing connected to one end side of the stator; an end stud connected to the other end side of the stator; and a position adjusting member that adjusts a relative position of the stator with respect to the rotor in an axial direction.

Means for Solving the Problem

The present invention provides, as means for solving the above problem, a uniaxial eccentric screw pump including: a rotor including a male threaded shaft body; a stator having a female threaded through hole through which the rotor is inserted; a casing connected to one end side of the stator; an end stud connected to the other end side of the stator; and a position adjusting member that adjusts a relative position of the stator with respect to the rotor in an axial direction.

According to this configuration, the relative positional relationship of the stator with respect to the rotor in the axial direction can be adjusted by the position adjusting member.

It is preferable that a joint part that transmits power from a drive source to the rotor be provided, and the position adjusting member be detachably provided at an end part or in a middle of at least one of the rotor, the stator, the casing, and the joint part.

It is preferable that the position adjusting member be detachably attached to at least one of a part between the stator and the casing and a part between the stator and the end stud.

According to this configuration, by disposing the position adjusting member between the stator and the casing, the rotor can be moved closer to the casing with respect to the stator. On the other hand, by disposing the position adjusting member between the stator and the end stud, the rotor can be moved closer to the end stud with respect to the stator.

It is preferable that the position adjusting member be detachably attached to both of the part between the stator and the casing and the part between the stator and the end stud.

According to this configuration, the rotor can be moved to both the casing side and the end stud side with respect to the stator.

The position adjusting member may be detachably provided at a free end, a middle, or a base part of the rotor.

The position adjusting member may be detachably provided at an end part or in a middle of the joint part.

It is preferable that the uniaxial eccentric screw pump include a plurality of the position adjusting members.

According to this configuration, by changing the number of position adjusting members to be mounted, the rotor can be moved by a distance corresponding to the number of position adjusting members in any axial direction with respect to the stator.

It is preferable that the axial lengths of the position adjusting members be the same.

According to this configuration, the rotor can be moved in the axial direction with respect to the stator by a distance proportional to the number of position adjusting members to be attached and detached.

It is preferable that an eccentricity of the rotor change in the axial direction.

According to this configuration, by changing the relative positional relationship between the rotor and the stator in the axial direction, the amount of eccentricity between the rotor and the stator is adjusted, and the interference between the rotor and the stator can be set freely.

It is preferable that at least one of an outer diameter of the rotor and an inner diameter of the through hole of the stator change in the axial direction.

According to this configuration, by changing the relative positional relationship between the rotor and the stator in the axial direction, the radial positional relationship between the rotor and the stator can be adjusted, and the interference between the rotor and the stator can be set freely.

It is preferable that the outer diameter of the rotor decrease in the axial direction, the inner diameter of the through hole of the stator decrease according to the change in the outer diameter of the rotor, and the amount of eccentricity of the rotor increase from a large-diameter side toward a small-diameter side of the rotor.

According to this configuration, by changing the relative positional relationship between the rotor and the stator in the axial direction, the interference between the rotor and the stator can be adjusted. Note, however, that since the change in the cavity volume is curbed by the change in the amount of eccentricity, the fluid can be transferred more stably.

It is preferable that volumes of a plurality of cavities formed between the rotor and the stator by inserting the rotor into the stator be equal.

According to this configuration, the fluid to be conveyed is less likely to expand and contract in each cavity, and a stable conveyance state can be obtained, It is preferable that the position adjusting member have a hollow cylindrical shape, and an inner peripheral surface of the position adjusting member be formed in a female screw same as or similar to an inner peripheral surface of the through hole of the stator.

According to this configuration, the relative positional relationship between the rotor and the stator in the axial direction can be changed, and the pump can have an additional function such as a defoaming function depending on the size of the inner diameter of the position adjusting member.

According to the aspect of the present invention, the relative positional relationship of the stator with respect to the rotor in the axial direction can be set freely by the position adjusting member.

BRIEF DESCRIPTION OF THE DRAWINGS

The foregoing and the other features of the present invention will become apparent from the following description and drawings of an illustrative embodiment of the invention in which.

MODES FOR CARRYING OUT THE INVENTION

Hereinafter, embodiments according to the present invention will be described with reference to the accompanying drawings. Note that the following description is merely exemplary in nature, and is not intended to limit the present invention, its application, or its use.

First Embodiment

Figure 1:
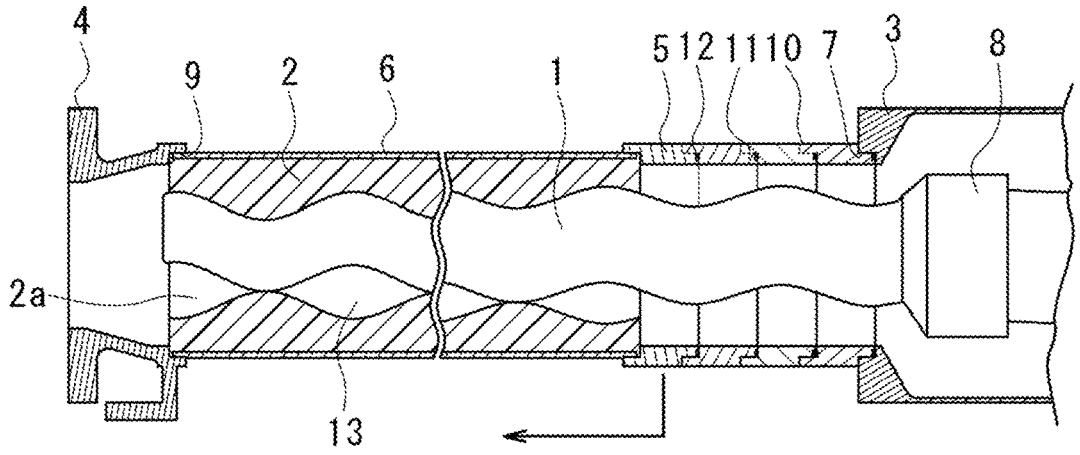
FIG. 1 is a cross-sectional view illustrating a part of a uniaxial eccentric screw pump according to a first embodiment.

As illustrated in FIG. 1, a uniaxial eccentric screw pump according to a first embodiment includes a rotor 1, a stator 2, a casing 3, an end stud 4, and a position adjusting member 5.

Figure 3:
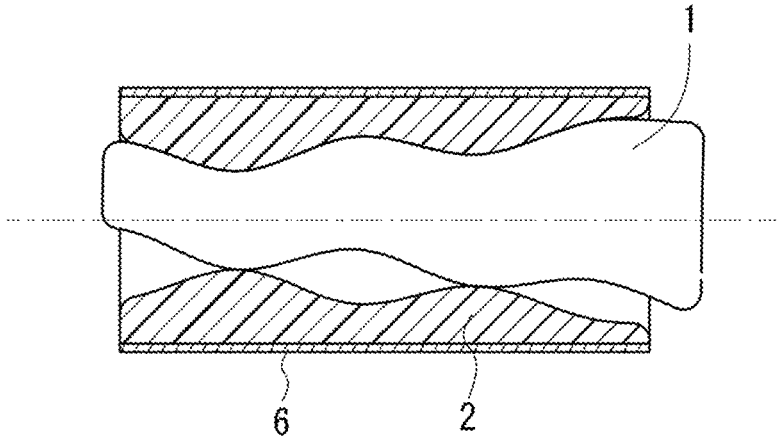
FIG. 3 is an explanatory view in which configurations of a stator and a rotor in FIG. 1 are simplified.

In the rotor 1, a shaft body made of a metal material such as stainless steel is formed into a single-stage or multi-stage male screw shape with n−1 threads. Additionally, the rotor 1 forms a virtual cone shape as a whole from one end to the other end (see FIG. 3). In the present embodiment, while the cross-sectional shape of the rotor 1 is substantially a perfect circle (n=2), the outer diameter (cross-sectional area) of the rotor 1 gradually decreases from one end toward the other end (from right side to left side in FIG. 3).

The stator 2 has a hollow tubular shape extending from one end toward the other end, and is formed of an elastic material such as rubber or resin (e.g., rubber or fluororubber) appropriately selected according to the fluid to be conveyed. A through hole 2*a* of the stator 2 has a single-stage or multi-stage female screw shape with n threads, and the rotor 1 is inserted through the through hole 2*a*, The through hole 2*a* is formed to have a virtual cone shape as a whole from one end to the other end in accordance with the shape of the rotor 1 (see FIG. 3). That is, while the cross-sectional shape of the through hole 2*a* is racetrack shape, the inner diameter (cross-sectional area) of the through hole 2*a* gradually decreases from one end toward the other end (from right side to left side in FIG. 3). In a state where the rotor 1 is inserted through the through hole 2*a* of the stator 2, a plurality of conveying spaces (cavities) 13 are formed between an inner surface of the through hole 2*a* of the stator 2 and an outer surface of the rotor 1. Here, the volumes of the conveying spaces 13 are the same. Additionally, an outer cylinder 6 made of a metal material such as stainless steel is mounted on an outer peripheral surface of the stator 2, and the stator 2 is prevented from being deformed radially outward.

The shaft center of the rotor 1 and the shaft center of the stator 2 are decentered, and the amount of eccentricity increases from one end toward the other end. As a result, the volumes of the conveying spaces 13 are the same.

Additionally; the rotor 1 and the stator 2 form a virtual cone shape as a whole. For this reason, when the rotor 1 is moved relatively to the left side with respect to the stator 2, the contact pressure between the inner surface forming the through hole 2*a* of the stator 2 and the outer surface of the rotor 1 increases. As a result, the interference of the stator 2 with the rotor 1 can be increased. Conversely, when the rotor 1 is moved relatively to the right side with respect to the stator 2, the interference of the stator 2 with the rotor 1 can be reduced.

Note that while the outer diameter of the rotor 1 and the inner diameter of the through hale 2*a* of the stator 2 are gradually reduced from one end to the other end in this example, it is sufficient that at least one of them have such a configuration.

The casing 3 is made of a metal material such as stainless steel in a hollow cylindrical shape, and one end part thereof is connected to one end side of the stator 2. A stepped connection receiving part 7 having an enlarged inner diameter is formed on one end face of the casing 3. One end part of the outer cylinder 6 and a connecting part 11 of the position adjusting member 5 described later are connected to the connection receiving part 7. A connection pipe (not illustrated) is connected to the casing 3, and a fluid is supplied thereto. Additionally, a joint part 8 is disposed in the casing 3. A drive shaft (not illustrated) extending from a drive source is connected to one end side of the joint part 8. The rotor 1 is connected to the other end part of the joint part 8. As a result, the driving force from the drive source is transmitted to the rotor 1, and the rotor 1 is rotationally driven.

The end stud 4 is made of a metal material such as stainless steel, and one end part thereof is connected to the other end side of the stator 2. A stepped connection receiving part 9 having an enlarged inner diameter is formed on one end face of the end stud 4. The other end part of the outer cylinder 6 and the connecting part 11 of the position adjusting member 5 described later are connected to the connection receiving part 9. Additionally; the end stud 4 forms an outlet for discharging a fluid flowing through the through hole 2*a* of the stator 2.

The position adjusting member 5 is made of a metal material such as stainless steel in a hollow cylindrical shape, and as disposed between one end part of the outer cylinder 6 and, one end part of the casing 3 (four position adjusting members 5 are connected in this example). One end opening of the position adjusting member 5 is formed of a stepped connection receiving part 10 having an increased inner diameter. The other end opening of the position adjusting member 5 is formed of a stepped connecting part 11 having a reduced outer diameter. The position adjusting members 5 are connected to each other in a sealed state by coupling the connecting part 11 to the connection receiving part 10 via a packing 12. The position adjusting member 5 and the casing 3 are connected in a sealed state by coupling the connection receiving part 7 of the casing 3 to the connecting part 11 of the position adjusting member 5 via the packing 12. The position adjusting member 5 and the outer cylinder 6 are connected to each other by coupling one end part of the outer cylinder 6 to the connection receiving part 10 of the position adjusting member 5. At this time, a part of the stator 2 is interposed between the connection receiving part 10 of the position adjusting member 5 and, one end part of the outer cylinder 6 to form, a sealed state. The position adjusting member 5 can be moved to between the end stud 4 and the stator 2. In this case, the position adjusting member 5 and the end stud 4 are connected in a sealed state by coupling the connecting part 11 of the position adjusting member 5 to the connection receiving part 9 of the end stud 4 via the packing 12. Additionally, the position adjusting member 5 and the outer cylinder 6 of the stator 2 are connected to each other by coupling the other end part of the outer cylinder 6 to the connection receiving part 10 of the position adjusting member 5. At this time, a part of the stator 2 is interposed between the connection receiving part 10 of the position adjusting member 5 and the other end part of the outer cylinder 6 to form a sealed state.

In the uniaxial eccentric screw pump having the above configuration, at an initial stage, for example, as illustrated in FIG. 1, in a state where four position adjusting members 5 are connected between the stator 2 and the casing 3, the uniaxial eccentric screw pump is used with a desired interference formed between the rotor 1 and the stator 2. In this state, when power is transmitted from a drive system (not illustrated) via the joint part S and the rotor 1 rotates, the fluid supplied into the casing 3 is conveyed toward the end stud 4 via the conveying spaces (cavities) 13 formed between the stator 2 and the rotor 1.

Figure 2:
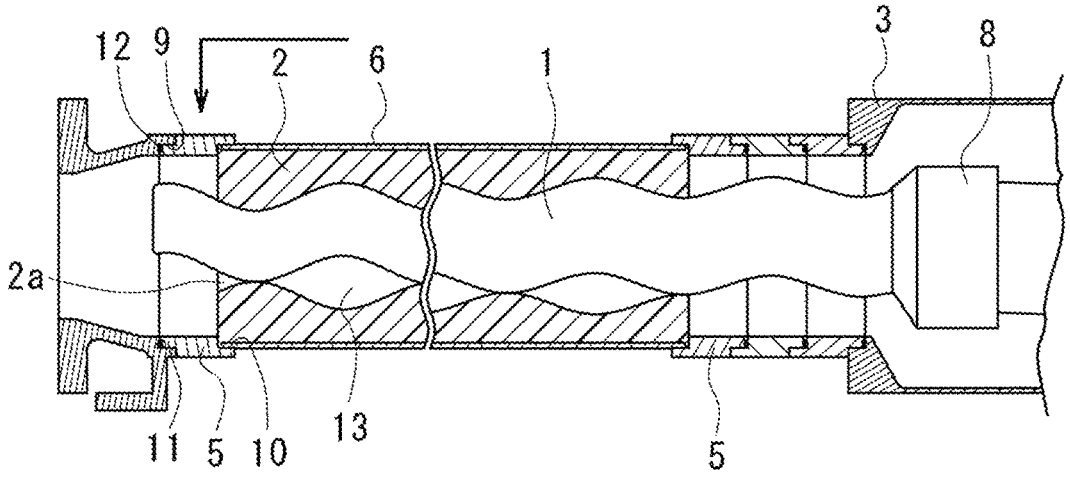
FIG. 2 is a cross-sectional view illustrating a state in which a position adjusting member is moved from the state in FIG. 1.

When the inner surface forming the through hole 2*a* of the stator 2 is worn by use and the interference of the stator 2 with the rotor 1 becomes small, one of the four position adjusting members 5 connected between the stator 2 and the casing 3 is removed as indicated by an arrow in FIG. 1, and is moved to between the stator 2 and the end stud 4 as indicated by an arrow in FIG. 2. As a result, the relative positional relationship between the stator 2 and the rotor 1 is shifted by the axial length of one moved position adjusting member 5. That is, the position where the rotor 1 is in sliding contact with the inner surface forming the through hole 2*a* of the stator 2 is changed to a position having a larger cross-sectional area, and the interference of the stator 2 with the rotor 1 can be corrected to be larger.

Thereafter, when the stator 2 is further worn, the remaining position adjusting members 5 positioned between the stator 2 and the casing 3 may be sequentially removed and moved to between the stator 2 and the end stud 4. Note that the wear state of the stator 2 may be determined by visually observing the conveyance state of the fluid or be simply automatically determined by the rotation speed of the rotor 1.

In this manner, by increasing the number of position adjusting members 5 to be moved from between the stator 2 and the casing 3 to between the stator 2 and the end stud 4 in accordance with the degree of wear of the stator 2, the interference of the stator 2 can be improved to an appropriate amount at any time. The improvement of the interference can continue until all the position adjusting members 5 have been replaced.

Additionally, conditions for obtaining a desired interference between the rotor 1 and the stator 2 differ depending on the type of fluid to be conveyed and the environment to be used. Hence, a reference condition may be determined, and the position adjusting member 5 may be mounted between the stator 2 and the casing 3 and between the stator 2 and the end stud 4, so that the rotor 1 and the stator 2 are at positions where a desired interference can be obtained at that time.

For example, when the ambient temperature is higher than a certain reference temperature (normal temperature of 15° C. to 25° C., such as 20° C.), it is necessary to consider expansion and the like of the stator 2. Hence, the number of position adjusting members 5 between the stator 2 and the casing 3 may be increased to move the rotor 1 to the right side with respect to the stator 2 in FIGS. 1 and 2. As a result, it is possible to prevent the interference of the stator 2 with the rotor 1 from becoming too large and to convey the fluid appropriately. On the other hand, when the ambient temperature is lower than the reference temperature, the number of position adjusting members 5 between the stator 2 and the end stud 4 may be increased to prevent a decrease in the interference of the stator 2 with the rotor 1.

Alternatively, when the fluid has a viscosity higher than a certain reference viscosity (e.g., viscosity of standard solution for calibration), the number of position adjusting members 5 between the stator 2 and the casing 3 may be increased to move the rotor 1 to the right side with respect to the stator 2 in FIGS. 1 and 2, so that the interference may be suppressed to facilitate the conveyance of the fluid. On the other hand, when the fluid has a viscosity lower than a certain reference viscosity, the number of the position adjusting members 5 between the stator 2 and the end stud 4 may be increased to increase the interference, so that leakage of the fluid from the conveying space 13 may be prevented.

According to the uniaxial eccentric screw pump having the above configuration, the following effects can be obtained.

(1) Even if the stator 2 wears, the interference of the stator with the rotor 1 can be restored to the original state only by changing the mounting place of the position adjusting member 5 from between the stator 2 and the casing 3 to between the stator 2 and the end stud 4.

(2) By changing the mounting place of the position adjusting member 5, the interference of the stator 2 with the rotor 1 can be set to an appropriate value according to the difference in conditions such as the viscosity of the fluid and the ambient temperature, and the conveyance state of the fluid can be maintained in a favorable state.

(3) Since it is only necessary to move the position adjusting member 5 to between the stator 2 and the casing 3 or to between the stator 2 and the end stud 4, the interference of the stator 2 with the rotor 1 can be adjusted easily.

Second Embodiment

Figure 4:
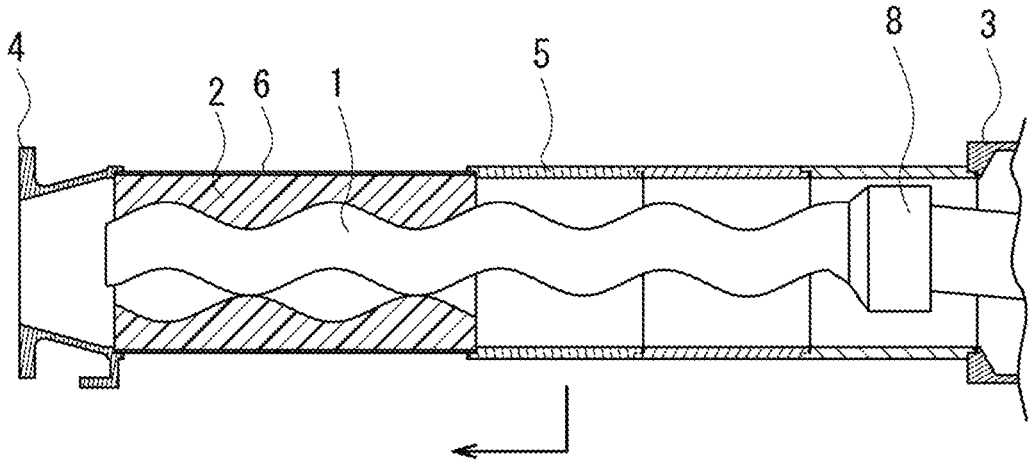
FIG. 4 is a cross-sectional view illustrating a part of a uniaxial eccentric screw pump according to a second embodiment.

As illustrated in FIG. 4, a uniaxial eccentric screw pump according to a second embodiment has substantially the same configuration as that of the first embodiment except for the following points.

In the second embodiment, a rotor 1 has the same cross-sectional area from one end toward the other end. Additionally, a through hole 2*a* of a stator 2 also has the same cross-sectional area from one end to the other end. Then, in an initial use state, the rotor 1 has a first region located in the through hole 2*a* of the stator 2 and a second region located in a position adjusting member 5.

Figure 5:
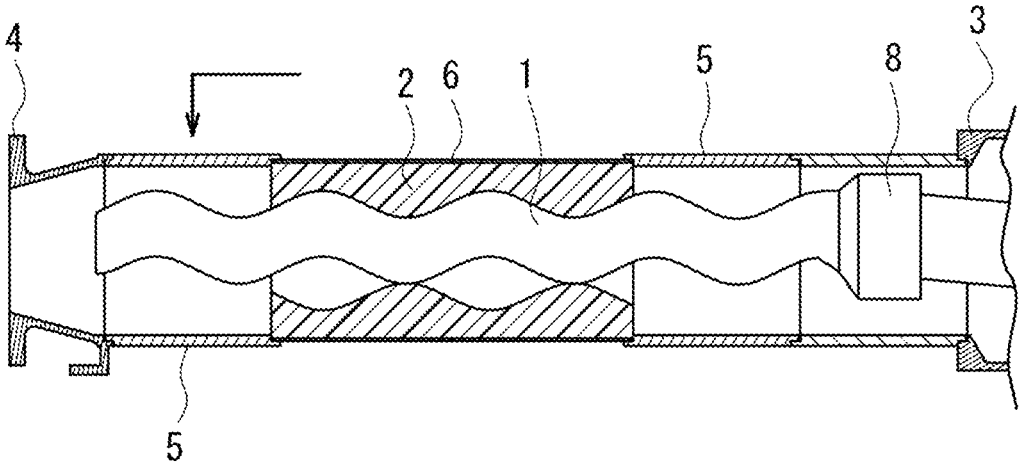
FIG. 5 is a cross-sectional view illustrating a state in which a position adjusting member is moved from the state in FIG. 4.

According to the uniaxial eccentric screw pump of the second embodiment, when a part of the rotor 1 is damaged during use, for example by a fluid, the position adjusting member 5 is moved, and the position where the rotor 1 is in sliding contact with the stator 2 is changed as illustrated in FIG. 5. As a result, the conveyance of the fluid can be restored to an appropriate state.

Additionally, when the amount of eccentricity of the rotor 1 is changed in the axial direction of the stator 2, the volume of the conveying space 13 can be reduced or increased in the axial direction by shifting the position of the rotor 1 in the axial direction. For example, when the rotation center of the rotor 1 is gradually brought closer to the shaft center of the stator 2 toward the conveyance direction of the fluid in the axial direction of the stator 2, the ratio of the cross-sectional area occupied by the conveying space 13 can be reduced by moving the rotor 1 in the conveyance direction. That is, the volume of the conveying space 13 can be gradually reduced in the conveyance direction. Additionally, by moving the rotor 1 in a direction opposite to the conveyance direction, the ratio of the cross-sectional area occupied by the conveying space 13 can be increased.

Third Embodiment

Figure 6:
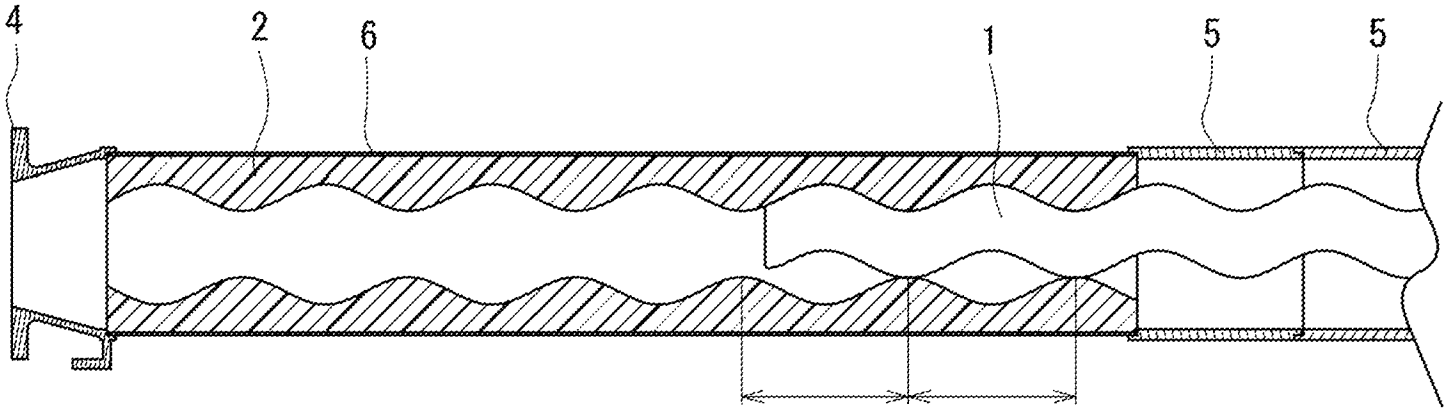
FIG. 6 is a cross-sectional view illustrating a part of a uniaxial eccentric screw pump according to a third embodiment.

As illustrated in FIG. 6, a uniaxial eccentric screw pump according to a third embodiment has substantially the same configuration as that of the first embodiment and the second embodiment except for the following points.

In the third embodiment, similarly to the second embodiment, a rotor 1 has the same cross-sectional area from one end to the other end. Additionally, a through hole 2*a* of a stator 2 also has the same cross-sectional shape from one end toward the other end. Note, however, that the stator 2 is different in that the length of the stator 2 set longer than that of the second embodiment. Here, the length of the stator 2 is set to about three tunes that of the second embodiment.

Figure 7:
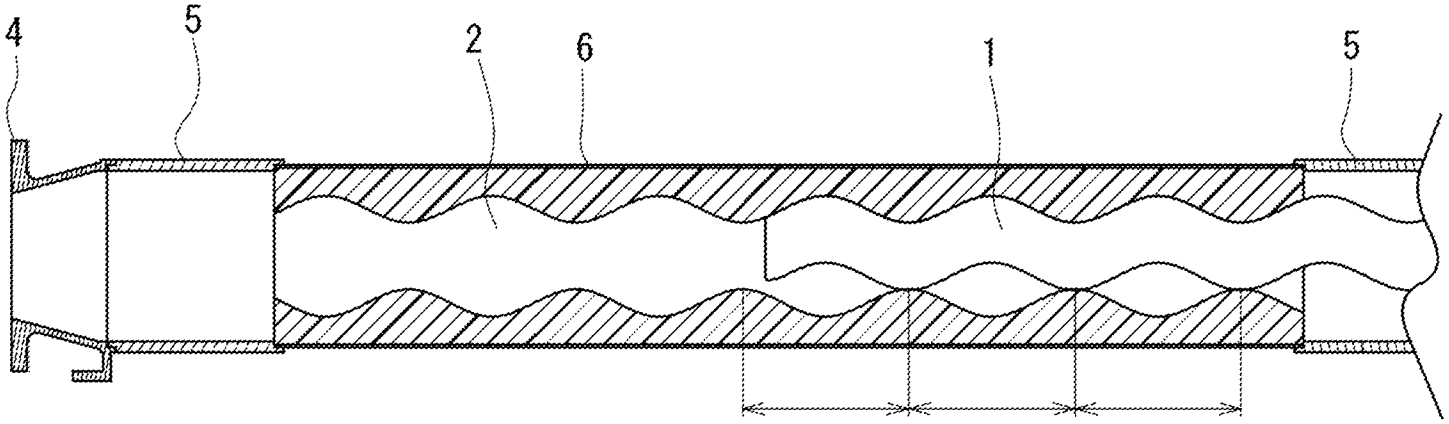
FIG. 7 is a cross-sectional view illustrating a state in which a position adjusting member is moved from the state in FIG. 6.

In the initial stage, the uniaxial eccentric screw pump according to the third embodiment is used with the rotor 1 inserted only on one end side of the stator 2 (here, about two pitches indicated by arrows in FIG. 6). Then, when the stator 2 \wears, a position adjusting member 5 between the stator 2 and a casing 3 is removed, and as illustrated in FIG. 7, the position adjusting member 5 is moved to between the stator 2 and an end stud 4 to further increase the amount of insertion of the rotor 1 into the stator 2 (here, insertion amount is increased from about two pitches of the through hole 2*a* to three pitches of the through hole 2*a*). As a result, a new non-worn region can be added to the contact range between an inner surface forming the through hole 2*a* of the stator 2 and an outer surface of the rotor 1, and the conveyance state of the fluid can be recovered. Since a region where the stator 2 is not worn can be used, the conveyance state of the fluid can be improved as compared with the first embodiment in which the worn part is continuously used.

Fourth Embodiment

A uniaxial eccentric screw pump according to a fourth embodiment has substantially the same configuration as that of the first embodiment except for the following points.

Figure 8:
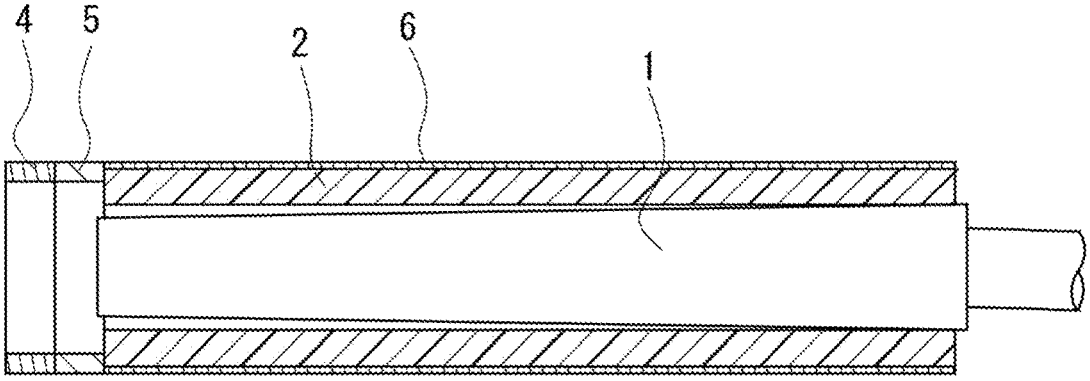
FIG. 8 is an explanatory view illustrating an inventive concept of a uniaxial eccentric screw pump according to a fourth embodiment.

As schematically illustrated in FIG. 8, a rotor 1 is formed such that the cross-sectional area gradually decreases from one end toward the other end (from right side to left side in FIG. 8) (in practice, the rotor 1 is formed in a single-stage or multi-stage male screw shape with n−1 threads similarly to the first embodiment and the like). Meanwhile, the cross-sectional area of the through hole 2*a* of the stator 2 is the same at any section in the axial direction.

Figure 9:
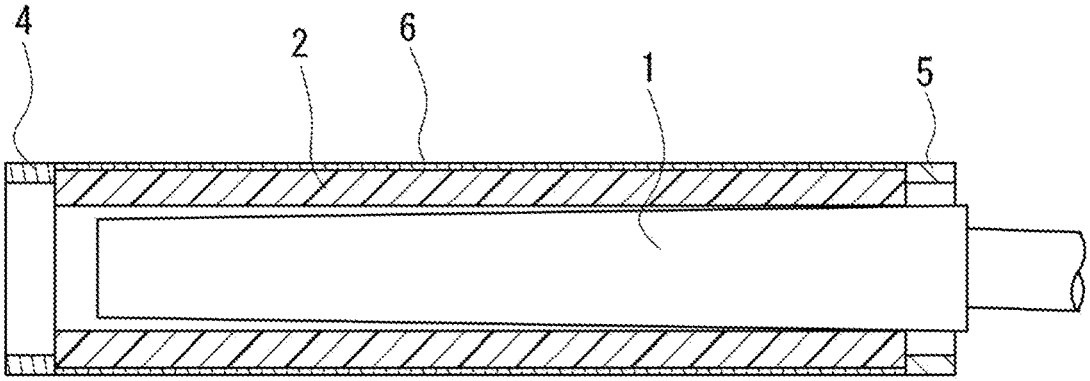
FIG. 9 is an explanatory view illustrating a state in which a position adjusting member is moved from the state in FIG. 8.

According to the uniaxial eccentric screw pump of the fourth embodiment, when the rotor 1 is rotated to convey the fluid, conveying spaces 13 gradually increase toward the downstream side. Hence, negative pressure can be generated in the conveying space 13 to precipitate and remove gas dissolved in the fluid as air bubbles. Then, in order to increase the negative pressure of the conveying space 13 and facilitate generation of even more air bubbles, as illustrated in FIG. 9, a position adjusting member 5 disposed between an end stud 4 and the stator 2 can be moved to between the stator 2 and a casing (not illustrated). As a result, the rotor 1 is retracted with respect to the stator 2 to increase the volume of the conveying space 13 (not illustrated in FIG. 9), and the gas dissolved in the fluid can be removed more easily.

Fifth Embodiment

A uniaxial eccentric screw pump according to a fifth embodiment has substantially the same configuration as that of the first embodiment except for the following points.

Figure 10:
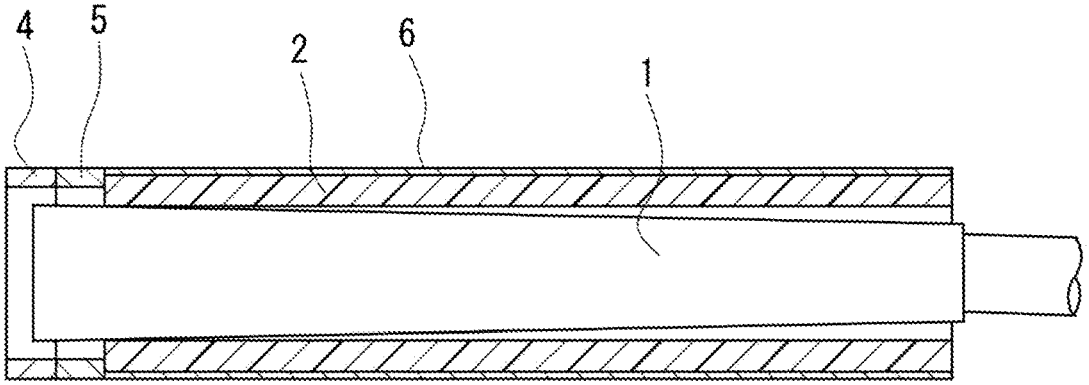
FIG. 10 is an explanatory view illustrating an inventive concept of a uniaxial eccentric screw pump according to a fifth embodiment.

As schematically illustrated in FIG. 10, the cross-sectional area of a rotor 1 gradually increases from one end toward the other end (from right side to left side in FIG. 10). Meanwhile, the cross-sectional area of a through hole 2*a* of a stator 2 is the same at any section in the axial direction.

Figure 11:
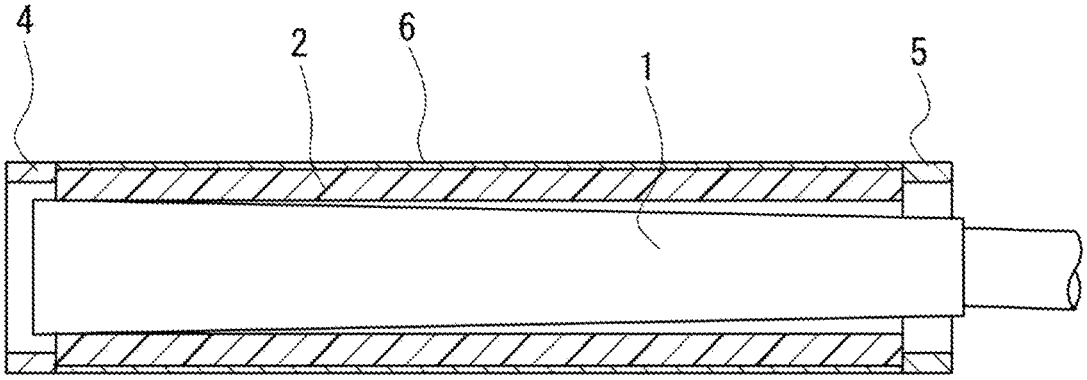
FIG. 11 is an explanatory view illustrating a state in which a position adjusting member is moved from the state in FIG. 10.

According to the uniaxial eccentric screw pump of the fifth embodiment, when the rotor 1 is rotated to convey the fluid, if air bubbles are contained in the fluid, the air bubbles can be pressurized and be dissolved in the fluid. Then, in order to further pressurize the fluid to dissolve air bubbles in the fluid, as illustrated in FIG. 11, a position adjusting member 5 disposed between an end stud 4 and the stator 2 can be moved to between the stator 2 and a casing (not illustrated), As a result, the tip end side of the rotor 1 having the large outer diameter can be moved into the through hole 2*a* (not illustrated in FIG. 11) of the stator 2, and the volume of a conveying space 13 can be reduced to dissolve the air bubbles more easily in the fluid.

Note that while only the cross-sectional area of the rotor 1 is changed in the fourth embodiment and the fifth embodiment, a similar effect can be obtained by changing the cross-sectional area of the through hole 2*a* of the stator 2 or changing both.

Sixth Embodiment

A uniaxial eccentric screw pump according to a sixth embodiment has substantially the same configuration as that of the first embodiment except for the following points.

Figure 12:
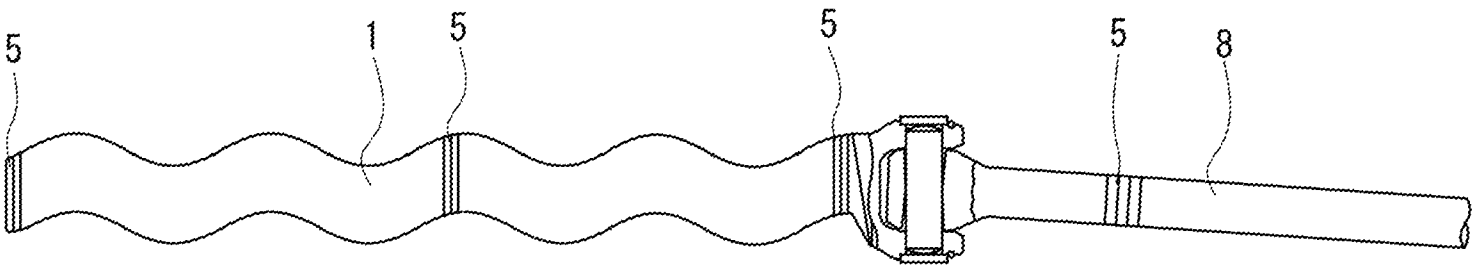
FIG. 12 is a cross-sectional view illustrating a rotor and a joint part of a uniaxial eccentric screw pump according to a sixth embodiment.

As illustrated in FIG. 12, a position adjusting member 5 can be detachably provided to a rotor 1 at the free end, the middle, the base (connection part with joint part 8), and the middle of the joint part 8. The position where the position adjusting member 5 is attached and detached may be any three, two, or one of these four positions.

Figure 13:
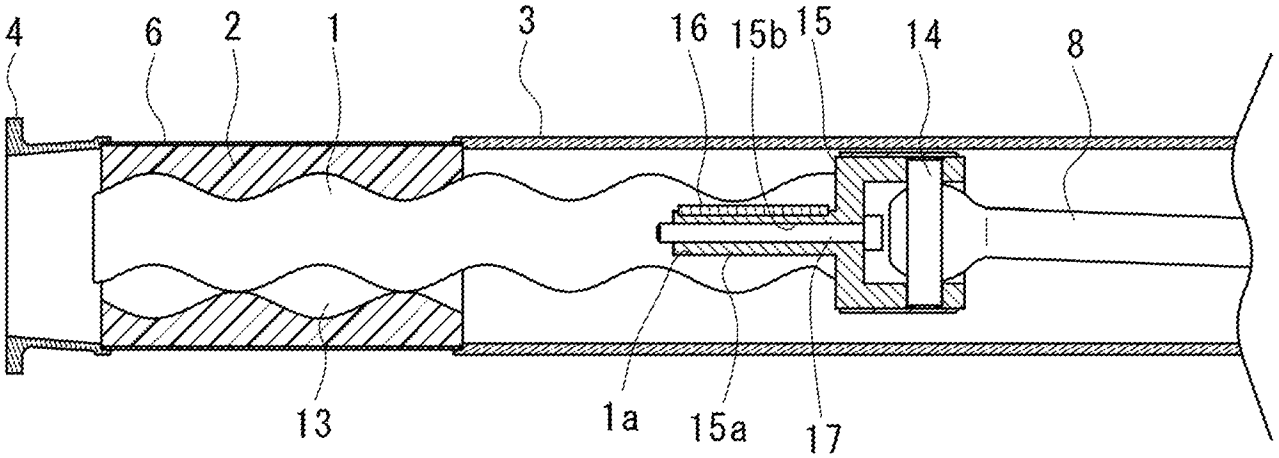
FIG. 13 is a cross-sectional view illustrating a part of a uniaxial eccentric screw pump according to another example of the sixth embodiment.
Figure 14:
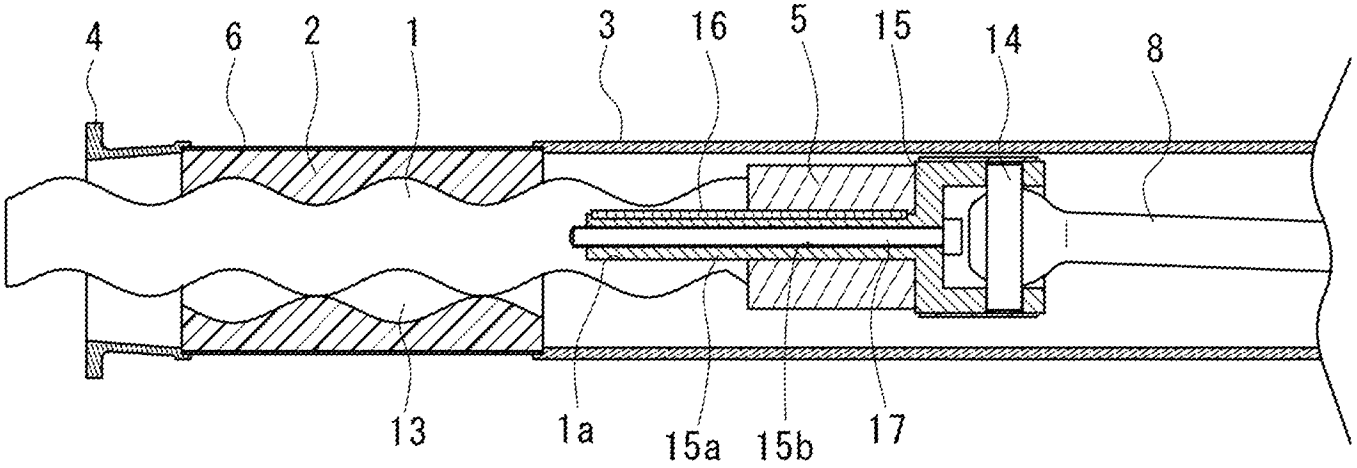
FIG. 14 is a cross-sectional view illustrating a state in which a position adjusting member is attached to the state in FIG. 13.

FIG. 13 illustrates an example in which the position adjusting member 5 is detachably provided at the connection part between the rotor 1 and the joint part 8. At one end part of the joint part 8, a coupling part 15 is coupled by a joint pin 14. A shaft part 15*a* protrudes from an end face of the coupling part 15, and a through hole 15*b* is formed at the center of the shaft part 15*a*. Meanwhile, an engagement hole 1*a* is formed in one end part of the rotor 1, and the shaft part 15*a* of the coupling part 15 is inserted. A key groove is formed between the shaft part 15*a* and the engagement hole 1*a*, and a key 16 is disposed in the key groove. By screwing a bolt 17 into the coupling part 15, the shaft part 15*a* swells to the outer diameter side, an outer peripheral surface of the shaft part 15*a* of the coupling part 15 is brought into pressure contact with an inner peripheral surface of the engagement hole 1*a* of the rotor 1, and the parts are coupled to each other. Additionally, the presence of the key 16 prevents rotation of the rotor 1 with respect to the coupling part 15. When changing the sliding contact position of the rotor 1 with respect to the stator 2, the position adjusting member 5 may be disposed between the coupling part 15 and the rotor 1 as illustrated in FIG. 14. In this case, the key 16 may be replaced to prevent rotation between the position adjusting member 5 and the shaft part 15*a* of the coupling part 15. As a result, if the cross-sectional area of the rotor 1 in the cross section is configured to increase toward the base end, the pressure contact force between an inner surface forming a through hole 2*a* of the stator 2 and an outer surface of the rotor 1 can be increased.

Figure 15:
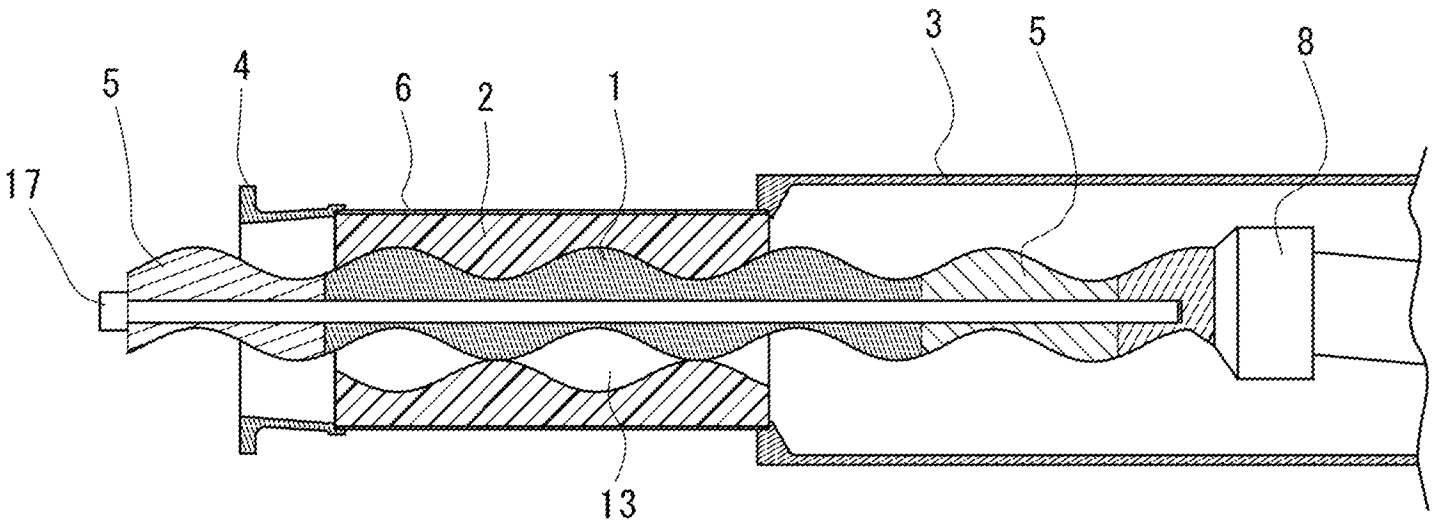
FIG. 15 is a cross-sectional view illustrating a part of a uniaxial eccentric screw pump according to another example of the sixth embodiment.
Figure 16:
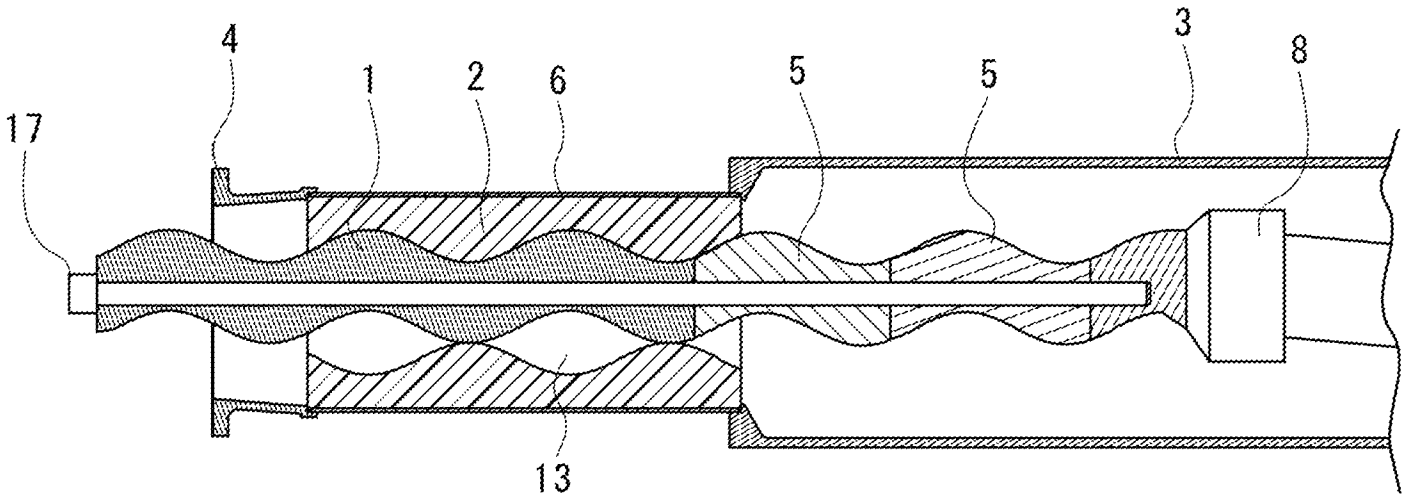
FIG. 16 is a cross-sectional view illustrating a state in which a position adjusting member is added to the state in FIG. 15.

FIG. 15 illustrates an example in which the position adjusting member 5 is detachably provided on the rotor 1. A tip end part and a part of a base end side of the rotor 1 are formed of the position adjusting member 5, and these parts are fixed by a bolt 17 inserted from the tip end side of the rotor 1. Here, one position adjusting member 5 forms one pitch of the rotor 1. When changing the sliding contact position of the rotor 1 with respect to the stator 2, as illustrated in FIG. 16, the position adjusting member 5 provided at the tip end part of the rotor 1 may be removed and attached to the base end side. As a result, the sliding contact position of the rotor 1 with respect to the stator 2 can be shifted by one pitch from the tip end side to the base end side. As a result, if the cross-sectional area of the rotor 1 in the cross section is configured to increase toward the base end, the pressure contact force between the inner surface forming the through hole 2*a* of the stator 2 and the outer surface of the rotor 1 can be increased.

Figure 17:
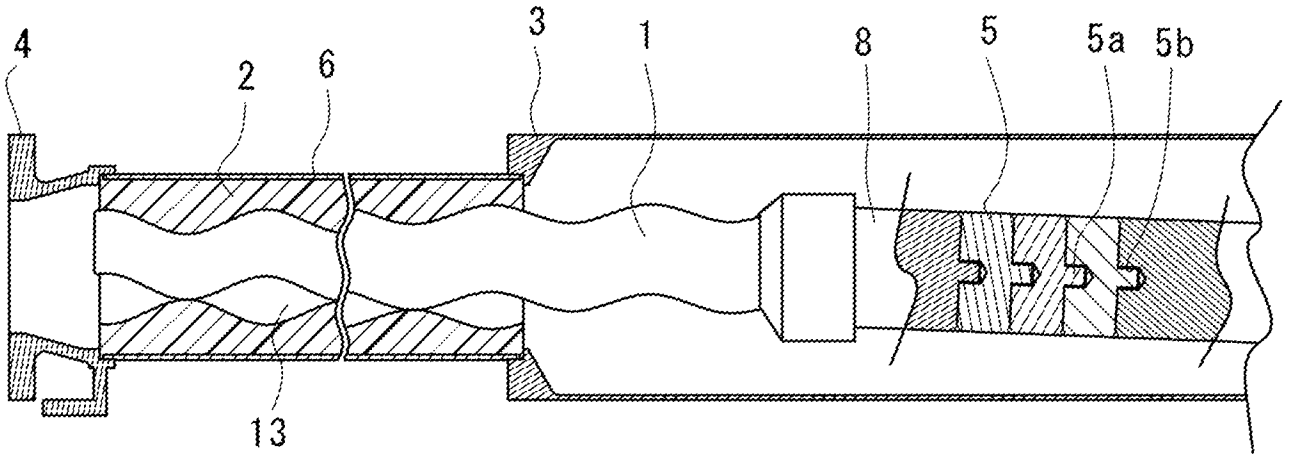
FIG. 17 is a cross-sectional view illustrating a part of a uniaxial eccentric screw pump according to another example of the sixth embodiment.
Figure 18:
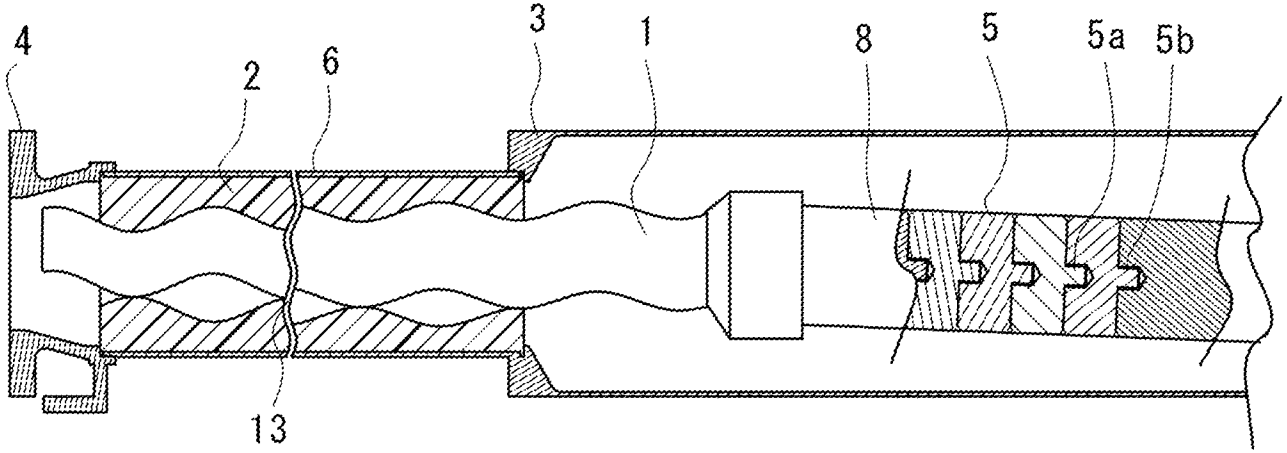
FIG. 18 is a cross-sectional view illustrating a state in which a position adjusting member is added to the state in FIG. 17.

FIG. 17 illustrates an example in which the position adjusting member 5 is detachably provided in the joint part 8. A part of the joint part 8 is formed by the position adjusting members 5 which are coupled to each other and are separable, Each position adjusting member 5 has a threaded part 5*a* at the center of one end face and a threaded hole 5*b* at the center of the other end face. By screwing the threaded part 5*a* into the threaded hole 5*b*, the position adjusting members 5 can be coupled to each other. By increasing the number of the position adjusting members 5 to be coupled, the rotor 1 can be moved to the tip end side in the axial direction with respect to the stator 2. In FIG. 18, one position adjusting member 5 is added to the three position adjusting members 5 coupled in FIG. 17, and a total of four position adjusting members 5 are coupled. As a result, the rotor 1 can be moved by one axial length of the position adjusting member 5. As a result, if the cross-sectional area of the rotor 1 in the cross section is configured to increase toward the base end, the pressure contact force between the inner surface forming the through hole 2*a* of the stator 2 and the outer surface of the rotor 1 can be increased.

Seventh Embodiment

A uniaxial eccentric screw pump according to a seventh embodiment has substantially the same configuration as that of the first embodiment except for the following points.

Figure 19:
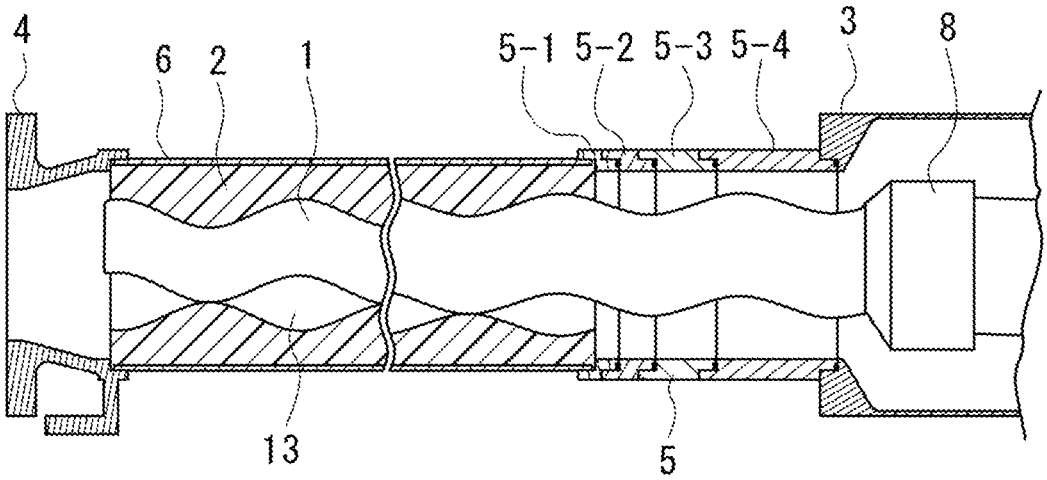
FIG. 19 is a cross-sectional view illustrating a part of a uniaxial eccentric screw pump according to a seventh embodiment.

As illustrated in FIG. 19, the position adjusting members 5 have different axial lengths. Here, the position adjusting member 5 includes four of the first to fourth position adjusting members, and the ratio of the axial lengths thereof is 1:2:3:4. Note, however, that the number, length, and length ratio of the position adjusting members 5 can be set freely.

According to the uniaxial eccentric screw pump of the seventh embodiment, by appropriately combining the position adjusting members 5, the degree of freedom in adjusting the position of the rotor 1 with respect to the stator 2 can be further increased. That is, from an initial state in which a first position adjusting member 5-1 to a fourth position adjusting member 5-4 are interposed between the stator 2 and the casing 3 in order, only the first position adjusting member 5-1 is moved to between the stator 2 and the end stud 4. Similarly, the second position adjusting member 5-2, the third position adjusting member 5-3, and the fourth position adjusting member 5-4 are sequentially moved one by one.

Thereafter, the position adjusting members 5 are moved in combinations of the respective position adjusting members 5. As a result, it is possible to widen the range of position adjustment of the rotor 1 as compared with a case where all the position adjusting members 5 have the same length.

Eighth Embodiment

A uniaxial eccentric screw pump according to an eighth embodiment has substantially the same configuration as that of the first embodiment except for the following points.

Figure 20:
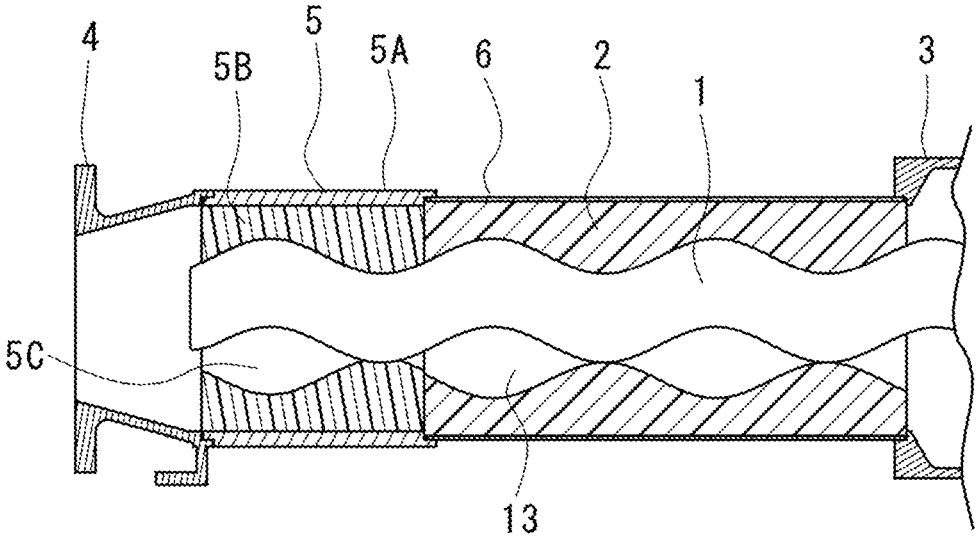
FIG. 20 is a cross-sectional view illustrating a part of a uniaxial eccentric screw pump according to an eighth embodiment.

As illustrated in FIG. 20, a position adjusting member 5 includes a cylindrical part 5A made of a metal material such as stainless steel and an inner diameter part 5B disposed on an inner diameter side of the cylindrical part 5A and made of a material similar to that of a stator 2. In the inner diameter part 5B, a through hole 50 having a single-stage or multi-stage female screw shape with n threads similar to the stator 2 is formed. For example, the through hole 5C of the position adjusting member 5 may have an inner diameter smaller than that of the stator 2, and the position adjusting member 5 may be disposed between the stator 2 and an end stud 4. As a result, it is possible to obtain a configuration in which, in addition to adjusting the axial positional relationship between the rotor 1 and the stator 2, the remaining air bubbles are dissolved in the fluid by pressurizing the fluid only by mounting the position adjusting member 5 without performing special processing on the stator 2. On the other hand, the through hole 50 of the position adjusting member 5 may have an inner diameter larger than that of the stator 2, and the position adjusting member 5 may be disposed between the stator 2 and the end stud 4. As a result, it is possible to obtain a configuration in which, in addition to adjusting the axial positional relationship between the rotor 1 and the stator 2, the air bubbles dissolved in the fluid are precipitated and removed as gas bubbles only by mounting the position adjusting member 5 without performing special processing on the stator 2. Further, the stator 2 can be substituted by the plurality of position adjusting embers 5 having the above configuration. As a result, it is possible to replace only the damaged position adjusting member 5, which is economical.

Ninth Embodiment

A uniaxial eccentric screw pump according to a ninth embodiment has substantially the same configuration as that of the first embodiment except for the following points.

Figure 21:
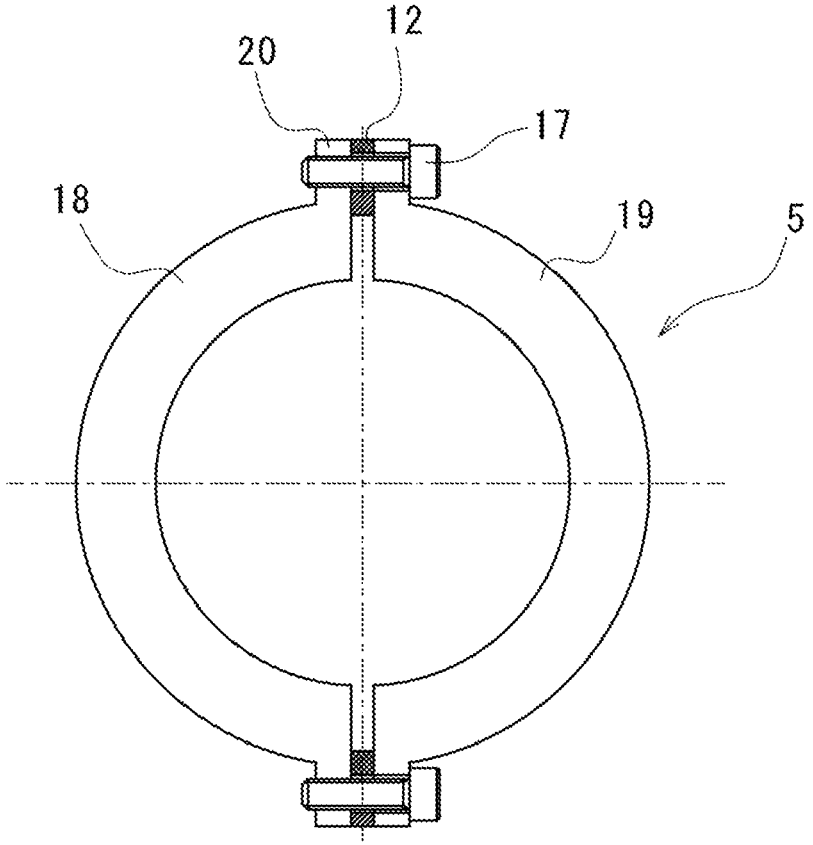
FIG. 21 is a side view illustrating a position adjusting member of a uniaxial eccentric screw pump according to a ninth embodiment.

As illustrated in FIG. 21, a position adjusting member 5 can be divided into a plurality of parts in the circumferential direction. Here, the position adjusting member 5 is circumferentially divided into two parts: a first position adjusting part 18 and a second position adjusting part 19. Both the first position adjusting part 18 and the second position adjusting part 19 have a semi-cylindrical shape, and an extending part 20 extending radially outward is formed on faces facing each other. The extending parts are connected to each other by a bolt 17 with a packing 12 interposed therebetween. According to this configuration, it is possible to attach and detach only the position adjusting member 5 easily by tightening or loosening the bolt 17.

Note that the present invention is not limited to the configurations described in the above embodiments, and various modifications can be made.

While examples including one to four position adjusting members 5 have been described in the above embodiments, the number of the position adjusting members 5 is not particularly limited, and may be five or more. In a case of providing only one position adjusting member 5, it is possible to provide the position adjusting member 5 only between the stator 2 and the casing 3 or between the stator 2 and the end stud 4, and move the position adjusting member 5 to the other position. It is also possible to attach and detach the position adjusting member 5 in a detachable manner to only one of a part between the stator 2 and the casing 3 and a part between the stator 2 and the end stud 4. Note, however, that it is more convenient to move the position adjusting member 5 between the part between the stator 2 and the casing 3 and the part between the stator 2 and the end stud 4, since the positional relationship can be adjusted without changing the overall length of the pump.

While the position adjusting member 5 is made of metal in the above embodiments, the position adjusting member 5 may be made of synthetic resin or rubber. If the position adjusting member 5 is made of synthetic resin or rubber, it can be easily removed only by cutting not requiring disassembly of the pump. Additionally, if the position adjusting member 5 is circumferentially divided into a plurality of parts as described above, disassembly of the pump itself is unnecessary even when attaching the position adjusting member 5.

In the above embodiment, the volume of the conveying space 13 can be increased or decreased toward one end side by, for example, gradually decreasing or conversely increasing the pitch of the screw shapes of the rotor 1 and the stator 2 toward one end side.

While the outer diameter dimension of the rotor 1 is gradually reduced toward the end stud 4 in the above embodiment, the outer diameter dimension may be gradually increased. Additionally, while the amount of eccentricity of the rotor 1 with respect to the stator 2 is increased toward the end stud 4 in the above embodiment, the amount of eccentricity may be decreased.

While the position adjusting member 5 is mounted between the stator 2 and the casing 3 in the above embodiment, the position adjusting member 5 may be mounted between divided casings 3. Alternatively, the position adjusting member 5 can also be mounted to an end part or a middle part of the stator 2. In short, the position adjusting member 5 may be detachably provided at an end part or in the middle of at least one of the rotor 1, the stator 2, the casing 3, and the joint part 8. The position adjusting member 5 can be provided in each of the rotor 1 and the casing 3, the stator 2 and the casing 3, and the like.

Figure 22:
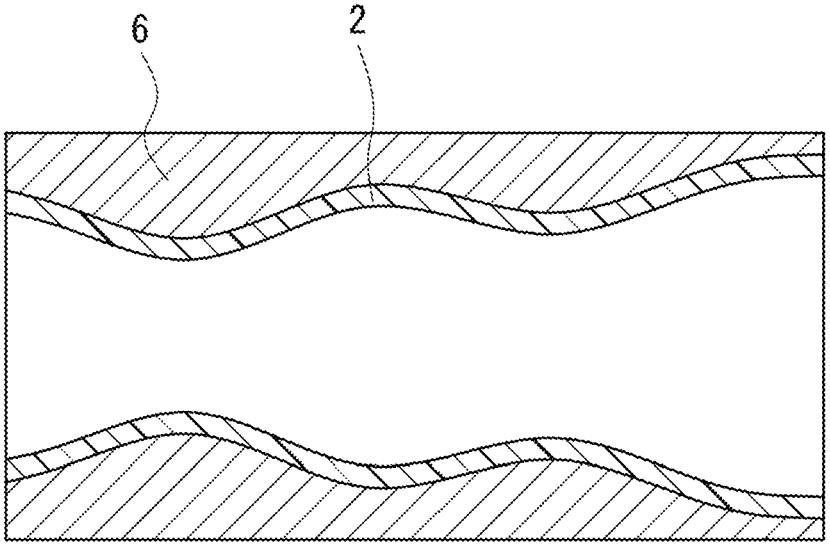
FIG. 22 is a cross-sectional view of a stator according to another embodiment.

While the thickness of the stator 2 is configured to change in the axial direction in the above embodiment, the thickness of the stator 2 is preferably configured to be uniform and not to change. FIG. 22 is a longitudinal sectional view of the stator 2. An inner surface of the outer cylinder 6 made of a metal material such as stainless steel is formed in a single-stage or multistage female screw shape with n threads. The stator 2 made of an elastic material such as rubber having a larger thermal expansion coefficient than the outer cylinder 6 has a uniform thickness as a whole, so that the thickness in the cross section is the same at any position and the thickness of each cross section shifted in the axial direction is the same at any cross section.

According to the uniaxial eccentric screw pump including the stator 2 having such a configuration, even when the temperature of the fluid or the ambient atmosphere changes, the interference with the rotor 1 does not vary. That is, since the thickness of the stator 2 in the cross section is the same at any position, the pressure contact force acting on the outer surface of the rotor 1 does not increase or decrease at any position in the cross section. Additionally, since the thickness is the same in any cross section in the axial direction of the stator, the friction does not increase or decrease at any particular position in the axial direction when the rotor 1 rotates. Accordingly, the interference of the stator 2 with the rotor 1 can be appropriately adjusted regardless of a temperature change of the fluid and the ambient atmosphere, and the rotation state of the rotor 1 can be stabilized. Note that the value of the thickness of the stator 2 may be determined according to the magnitude of the temperature change of the fluid and the ambient atmosphere. That is, the thickness may be set to be thin when used under a condition where the temperature change is large, and the thickness may be increased when used under a condition where the temperature change is small.

DESCRIPTION OF SYMBOLS

1 Rotor
2 Stator
3 Casing
4 End stud
5 Position adjusting member
6 Outer cylinder
7 Connection receiving part
8 Joint part
9 Connection receiving part
10 Connection receiving part
11 Connecting part
12 Packing
13 Conveying space
14 Joint pin
15 Coupling part
16 Key
17 Bolt
18 First position adjusting part
19 Second position adjusting part
20 Extending part

The invention claimed is:

1. A uniaxial eccentric screw pump comprising:
a rotor including a male threaded shaft body;
a stator having a female threaded through hole through which the rotor is inserted;
a casing connected to one end side of the stator;
an end stud connected to the other end side of the stator; and
a position adjusting member that adjusts a relative position of the stator with respect to the rotor in an axial direction,
wherein the position adjusting member is detachably attached to both the part between the stator and the casing and the part between the stator and the end stud.

2. The uniaxial eccentric screw pump according to claim 1, further comprising
a joint part that transmits power from a drive source to the rotor,
wherein the position adjusting member is detachably provided at an end part or in a middle of at least one of the rotor, the stator, the casing, and the joint part.

3. The uniaxial eccentric screw pump according to claim 1, wherein the position adjusting member is detachably attached to at least one of a part between the stator and the casing and a part between the stator and the end stud.

4. The uniaxial eccentric screw pump according to claim 1, wherein the position adjusting member is detachably provided at a free end, a middle, or a base part of the rotor.

5. The uniaxial eccentric screw pump according to claim 2, wherein the position adjusting member is detachably provided at an end part or in a middle of the joint part.

6. The uniaxial eccentric screw pump according to claim 1, further comprising
a plurality of the position adjusting members.

7. The uniaxial eccentric screw pump according to claim 6, wherein axial lengths of the position adjusting members are the same.

8. The uniaxial eccentric screw pump according to claim 1, wherein an eccentricity of the rotor changes in the axial direction.

9. The uniaxial eccentric screw pump according to claim 1, wherein at least one of an outer diameter of the rotor and an inner diameter of the through hole of the stator changes in the axial direction.

10. A uniaxial eccentric screw pump comprising:
a rotor including a male threaded shaft body;
a stator having a female threaded through hole through which the rotor is inserted;
a casing connected to one end side of the stator;
an end stud connected to the other end side of the stator; and
a position adjusting member that adjusts a relative position of the stator with respect to the rotor in an axial direction, wherein:
an outer diameter of the rotor decreases in the axial direction;
an inner diameter of the through hole of the stator decreases according to the change in the outer diameter of the rotor; and
an eccentricity of the rotor changes in the axial direction, and an amount of the eccentricity of the rotor increases from a large-diameter side toward a small-diameter side of the rotor.

11. The uniaxial eccentric screw pump according to claim 10, wherein volumes of a plurality of cavities formed between the rotor and the stator by inserting the rotor into the stator are equal.

12. A uniaxial eccentric screw pump comprising:
a rotor including a male threaded shaft body;
a stator having a female threaded through hole through which the rotor is inserted;
a casing connected to one end side of the stator;
an end stud connected to the other end side of the stator; and
a position adjusting member that adjusts a relative position of the stator with respect to the rotor in an axial direction,
wherein the position adjusting member has a hollow cylindrical shape, and an inner peripheral surface of the position adjusting member is formed in a female screw same as or similar to an inner peripheral surface of the through hole of the stator.

13. The uniaxial eccentric screw pump according to claim 2, wherein the position adjusting member is detachably attached to at least one of a part between the stator and the casing and a part between the stator and the end stud.

14. The uniaxial eccentric screw pump according to claim 2, wherein the position adjusting member is detachably provided at a free end, a middle, or a base part of the rotor.

15. The uniaxial eccentric screw pump according to claim 2, wherein the position adjusting member has a hollow cylindrical shape, and an inner peripheral surface of the position adjusting member is formed in a female screw same as or similar to an inner peripheral surface of the through hole of the stator.

* * * * *